US006786832B1

(12) United States Patent
Wu

(10) Patent No.: US 6,786,832 B1
(45) Date of Patent: Sep. 7, 2004

(54) HEIGHT ADJUSTABLE GOLF PRACTICING DEVICE

(75) Inventor: Ming-Che Wu, Chia-Yi (TW)

(73) Assignee: Acas Design Co., Ltd., Chia-Yi (TW)

( * ) Notice: Subject to any disclaimer, the term of this patent is extended or adjusted under 35 U.S.C. 154(b) by 0 days.

(21) Appl. No.: 10/747,344

(22) Filed: Dec. 29, 2003

(51) Int. Cl.[7] ..... A63B 69/36
(52) U.S. Cl. ..... 473/149
(58) Field of Search ..... 473/138, 139, 473/140, 141, 142, 143, 144, 145, 146, 147, 148, 149

(56) References Cited

U.S. PATENT DOCUMENTS 1,690,158 A * 11/1928 Currie ..... 473/146
1,976,405 A * 10/1934 Le Witt ..... 473/146
4,175,744 A * 11/1979 Llewellyn ..... 473/149
5,060,946 A * 10/1991 Taylor ..... 473/429
5,390,930 A * 2/1995 Hu et al. ..... 473/149
5,480,141 A * 1/1996 Wood ..... 473/429
5,513,847 A * 5/1996 Hu et al. ..... 473/140
5,860,874 A * 1/1999 Wateska et al. ..... 473/263
5,997,405 A * 12/1999 Russell et al. ..... 473/140
6,254,491 B1 * 7/2001 Chou ..... 473/140
6,425,830 B1 * 7/2002 Chou ..... 473/140

* cited by examiner

*Primary Examiner*—Gregory Vidovich
*Assistant Examiner*—Nini F. Legesse
(74) *Attorney, Agent, or Firm*—Charles E. Baxley

(57) ABSTRACT

A golf practicing device includes a rotation disk, a cover, a bar, and an adjusting knob. The golf practicing device has a height adjustable function. Thus, the height of the practicing ball of the bar can be adjusted arbitrarily so as to fit users of different heights and statures, thereby facilitating the users operating the golf practicing device.

12 Claims, 5 Drawing Sheets

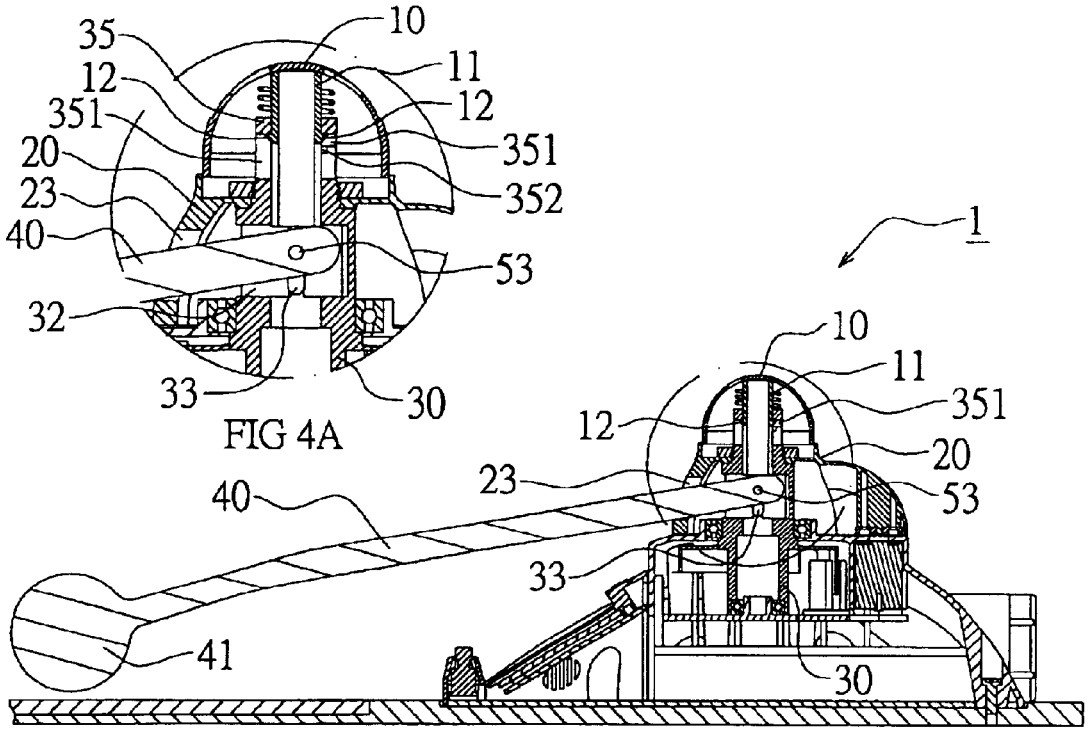
FIG 4A
FIG 4
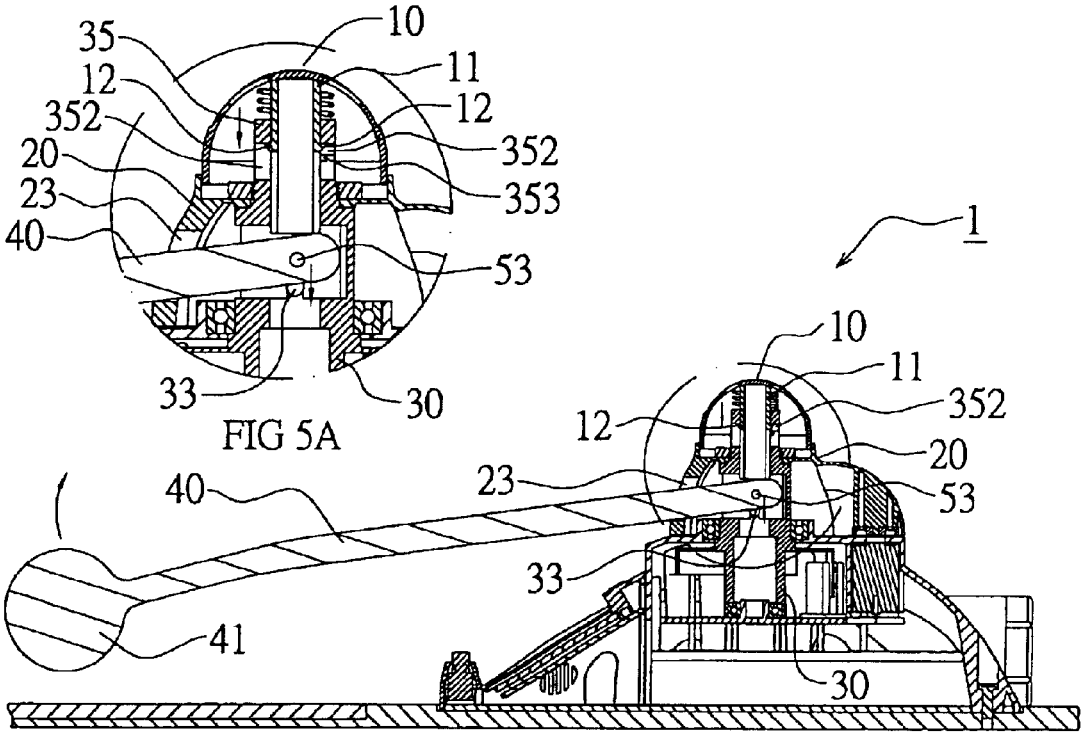
FIG 5A
FIG 5

HEIGHT ADJUSTABLE GOLF PRACTICING DEVICE

BACKGROUND OF THE INVENTION

1. Field of the Invention

The present invention relates to a golf practicing device, and more particularly to a height adjustable golf practicing device.

2. Description of the Related Art

A conventional golf practicing device comprises a rotation disk, and a bar having a first end mounted on the a rotation disk and a second end formed with a practicing ball. Thus, the user can practicing the golf skills indoors by striking the practicing ball. However, the practicing ball of the bar is located close to the ground, thereby causing inconvenience to the learner. In addition, the height of the practicing ball of the bar is fixed and cannot be adjusted so as to fit users of different heights and statures, thereby causing inconvenience to the users when using the golf practicing device.

SUMMARY OF THE INVENTION

The primary objective of the present invention is to provide a golf practicing device having a height adjustable function.

Another objective of the present invention is to provide a golf practicing device, wherein the height of the practicing ball of the bar can be adjusted arbitrarily so as to fit users of different heights and statures, thereby facilitating the users operating the golf practicing device.

In accordance with the present invention, there is provided a golf practicing device, comprising a rotation disk, a cover, a bar, and an adjusting knob, wherein:

the rotation disk has a first barrel and a second barrel, the first barrel of the rotation disk has a periphery formed with an opening and two opposite slide slots each communicating with the opening, the second barrel of the rotation disk has a first end extended from the first barrel of the rotation disk and has a periphery formed with two opposite first limit grooves, two opposite second limit grooves, two opposite third limit grooves, and two opposite fourth limit grooves;

the cover is secured on the rotation disk to rotate therewith and having a periphery formed with an oblong slot;

the bar is pivotally mounted on the cover and has a first end extended through the oblong slot of the cover and movably mounted in the opening of the first barrel; and the adjusting knob is movably mounted on the rotation disk and has an inside provided with a sleeve movably mounted in the second barrel of the rotation disk and rested on the first end of the bar.

Further benefits and advantages of the present invention will become apparent after a careful reading of the detailed description with appropriate reference to the accompanying drawings.

BRIEF DESCRIPTION OF THE DRAWINGS

FIG. 4 is a plan cross-sectional view of the golf practicing device as shown in FIG. 1;

FIG. 4A is a partially enlarged view of the golf practicing device as shown in FIG. 4;

FIG. 5 is a schematic operational view of the golf practicing device as shown in FIG. 4;

FIG. 5A is a partially enlarged view of the golf practicing device as shown in FIG. 5;

FIG. 6A is a partially enlarged view of the golf practicing device as shown in FIG. 6;

FIG. 7A is a partially enlarged view of the golf practicing device as shown in FIG. 7.

DETAILED DESCRIPTION OF THE INVENTION

Figure 1:
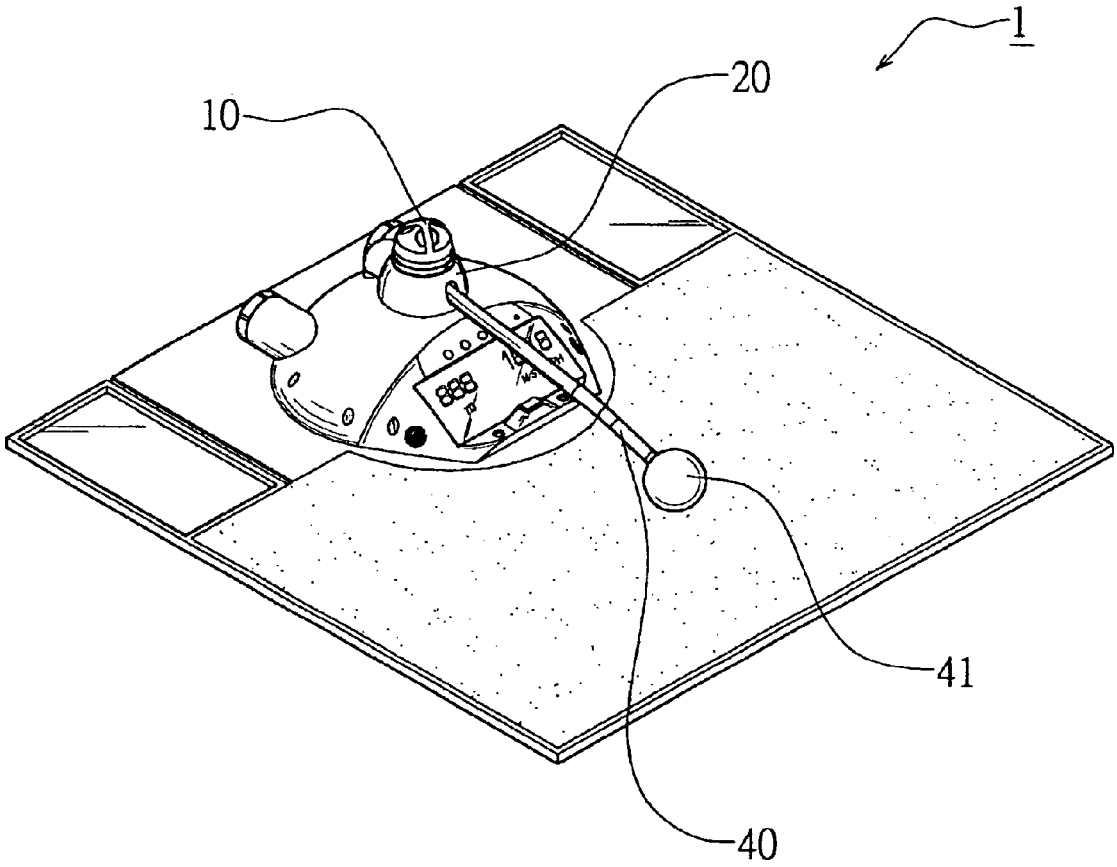
FIG. 1 is a perspective view of a golf practicing device in accordance with the preferred embodiment of the present invention.
Figures 2, 2A:
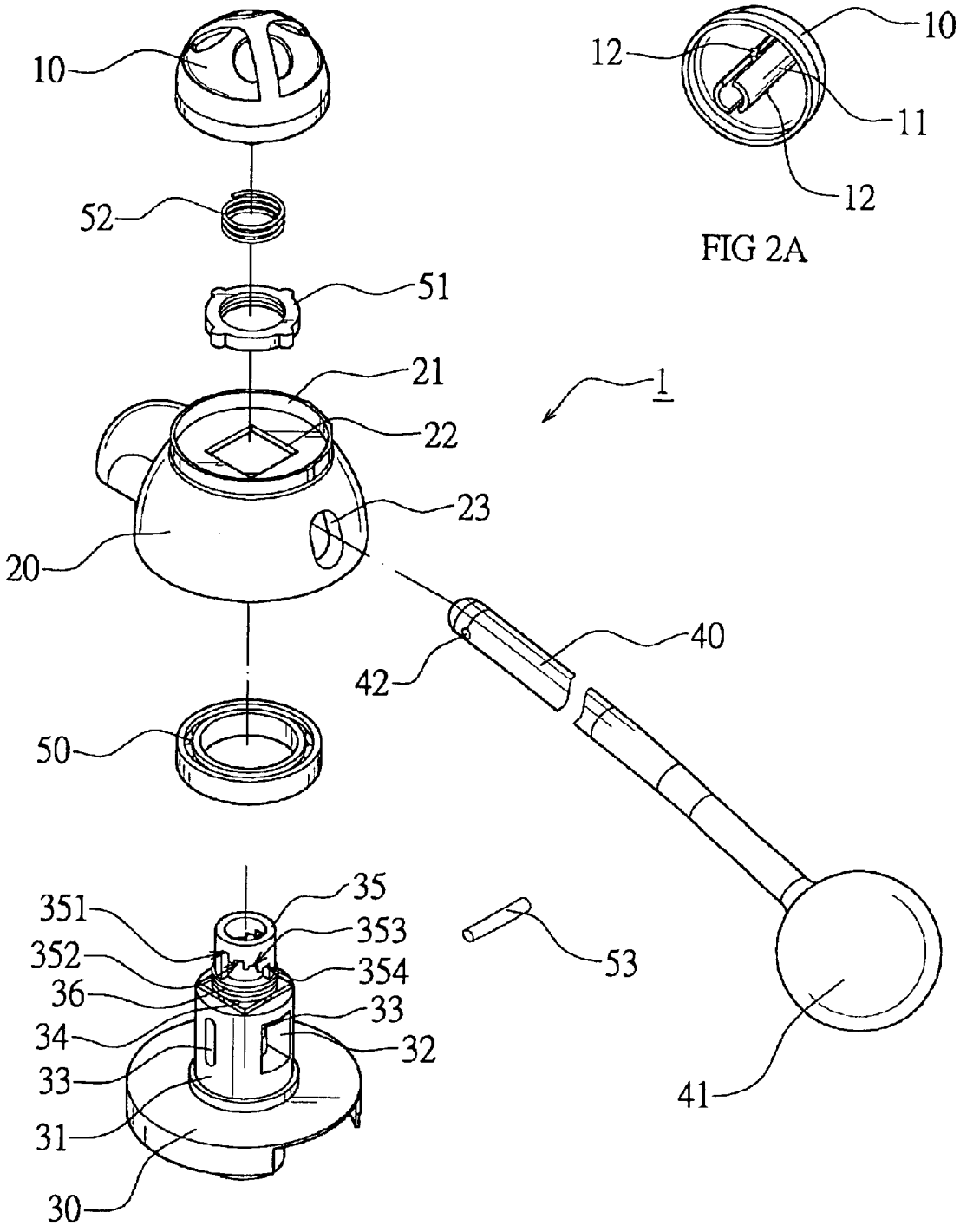
FIG. 2 is an exploded perspective view of the golf practicing device as shown in FIG. 1.
FIG. 2A is a perspective view of an adjusting knob of the golf practicing device as shown in FIG. 2.

Referring to the drawings and initially to FIGS. 1–4, a golf practicing device 1 in accordance with the preferred embodiment of the present invention comprises a rotation disk 30, a cover 20, a bar 40, and an adjusting knob 10.

The rotation disk 30 has a first barrel 31 and a second barrel 35. The first barrel 31 of the rotation disk 30 has a diameter greater than that of the second barrel 35. The first barrel 31 of the rotation disk 30 has a first end extended from the rotation disk 30 and a second end formed with an insert 34. The first barrel 31 of the rotation disk 30 has a periphery formed with an opening 32 and two opposite slide slots 33 each communicating with the opening 32.

Figure 3:
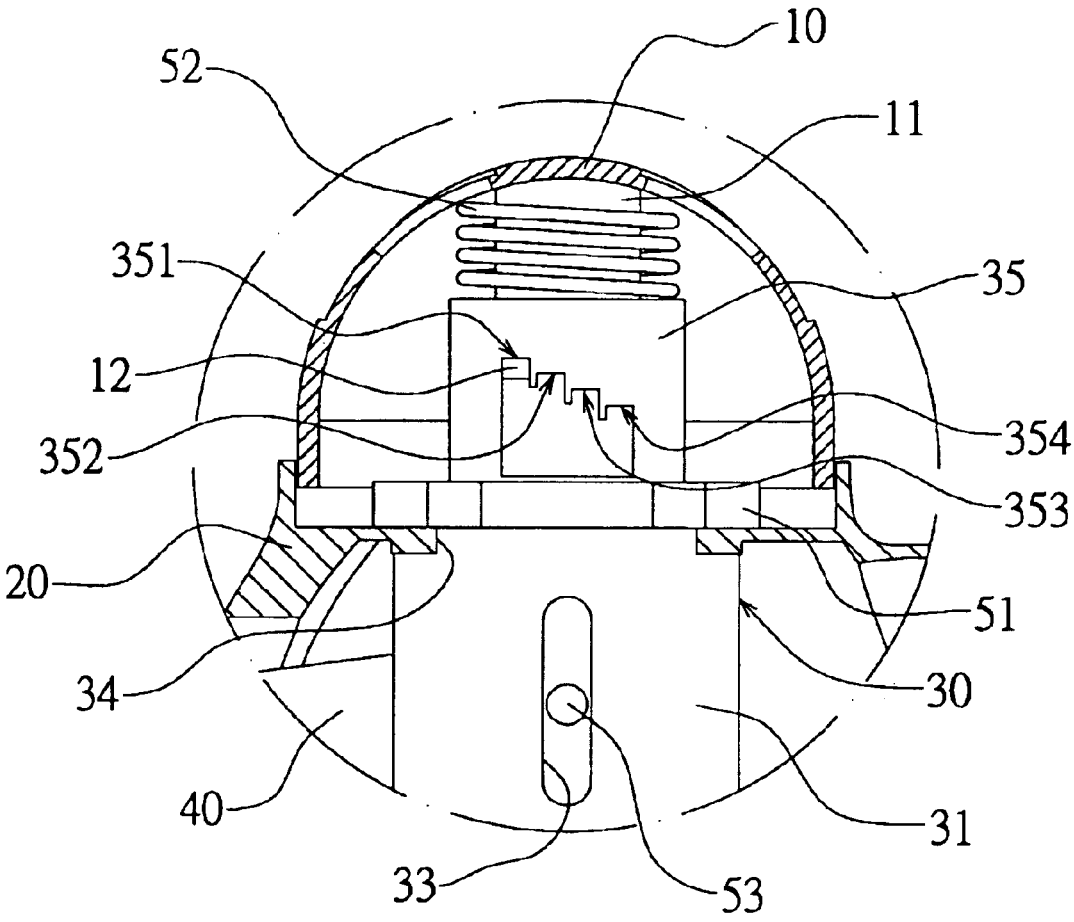
FIG. 3 is a partially plan cross-sectional view of the golf practicing device as shown in FIG. 1.

The second barrel 35 of the rotation disk 30 has a first end extended from the first barrel 31 of the rotation disk 30 and formed with an outer thread 36. The second barrel 35 of the rotation disk 30 has a periphery formed with two opposite first limit grooves 351, two opposite second limit grooves 352, two opposite third limit grooves 353, and two opposite fourth limit grooves 354. Preferably, the first limit grooves 351, the second limit grooves 352, the third limit grooves 353 and the fourth limit grooves 354 of the second barrel 35 are disposed at different locations as shown in FIG. 3.

The cover 20 is secured on the rotation disk 30 to rotate therewith. A bearing 50 is mounted on the first end of the first barrel 31 of the rotation disk 30 and rotatably mounted between the rotation disk 30 and the cover 20. The cover 20 has an upper portion formed with a recess 21 and a through hole 22 communicating with the recess 21. The second barrel 35 of the rotation disk 30 has a second end protruded outward from the cover 20. The insert 34 of the first barrel 31 is inserted into the through hole 22 of the cover 20. A nut 51 is screwed on the outer thread 36 of the second barrel 35 and rested on the cover 20 to secure the cover 20 on the rotation disk 30. The cover 20 has a periphery formed with an oblong slot 23.

The bar 40 is pivotally mounted on the cover 20 and has a first end extended through the oblong slot 23 of the cover 20 and movably mounted in the opening 32 of the first barrel 31. The first end of the bar 40 is formed with a through hole 42 aligning with the two opposite slide slots 33 of the first barrel 31. A pin 53 is extended through the through hole 42 of the bar 40 and is movably mounted in the two opposite slide slots 33 of the first barrel 31, so that the first end of the bar 40 is movable in the first barrel 31 of the rotation disk 30. The bar 40 has a second end formed with a practicing ball 41.

The adjusting knob 10 having a disk shape is movably mounted on the rotation disk 30 and has an inside provided with a sleeve 11 movably mounted in the second barrel 35 of the rotation disk 30 and rested on the first end of the bar 40. An elastic member 52 is mounted on the sleeve 11 of the adjusting knob 10 and is urged between the adjusting knob 10 and the rotation disk 30. The elastic member 52 has a first end urged on the inside of the adjusting knob 10 and a second end urged on the second end of the second barrel 35 of the rotation disk 30. The sleeve 11 of the adjusting knob 10 is provided with two opposite locking portions 12 selectively locked in the first limit grooves 351, the second limit grooves 352, the third limit grooves 353 and the fourth limit grooves 354 of the second barrel 35.

In operation, referring to FIGS. 4 and 4A, the locking portions 12 of the adjusting knob 10 are locked in the first limit grooves 351 of the rotation disk 30 as shown in FIG. 4A, and the practicing ball 41 of the bar 40 is located at the lowermost position.

As shown in FIGS. 5 and 5A, the adjusting knob 10 is pressed toward the rotation disk 30 to move the sleeve 11 downward which presses and moves the first end of the bar 40 downward in the first barrel 31 (the pin 53 is movable in the slide slots 33 of the first barrel 31) to pivot the bar 40 upward about the opening 32 of the first barrel 31, so that the practicing ball 41 of the bar 40 is moved upward and located at a higher position. At this time, the sleeve 11 of the adjusting knob 10 is moved downward, so that the locking portions 12 of the adjusting knob 10 are moved into and locked in the second limit grooves 352 of the rotation disk 30 as shown in FIG. 5A.

Figure 6:
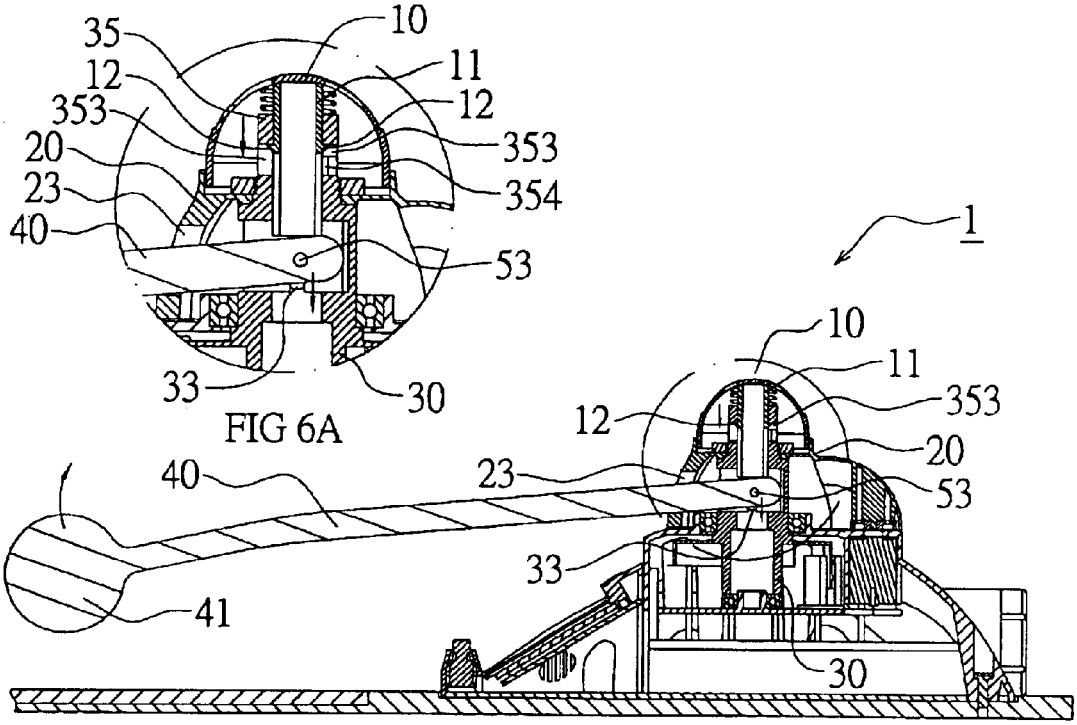
FIG. 6 is a schematic operational view of the golf practicing device as shown in FIG. 5.

As shown in FIGS. 6 and 6A, the adjusting knob 10 is further pressed toward the rotation disk 30 to move the sleeve 11 downward which presses and moves the first end of the bar 40 downward in the first barrel 31 (the pin 53 is movable in the slide slots 33 of the first barrel 31) to pivot the bar 40 upward about the opening 32 of the first barrel 31, so that the practicing ball 41 of the bar 40 is moved upward and located at a higher position. At this time, the sleeve 11 of the adjusting knob 10 is moved downward, so that the locking portions 12 of the adjusting knob 10 are moved into and locked in the third limit grooves 353 of the rotation disk 30 as shown in FIG. 6A.

Figure 7:
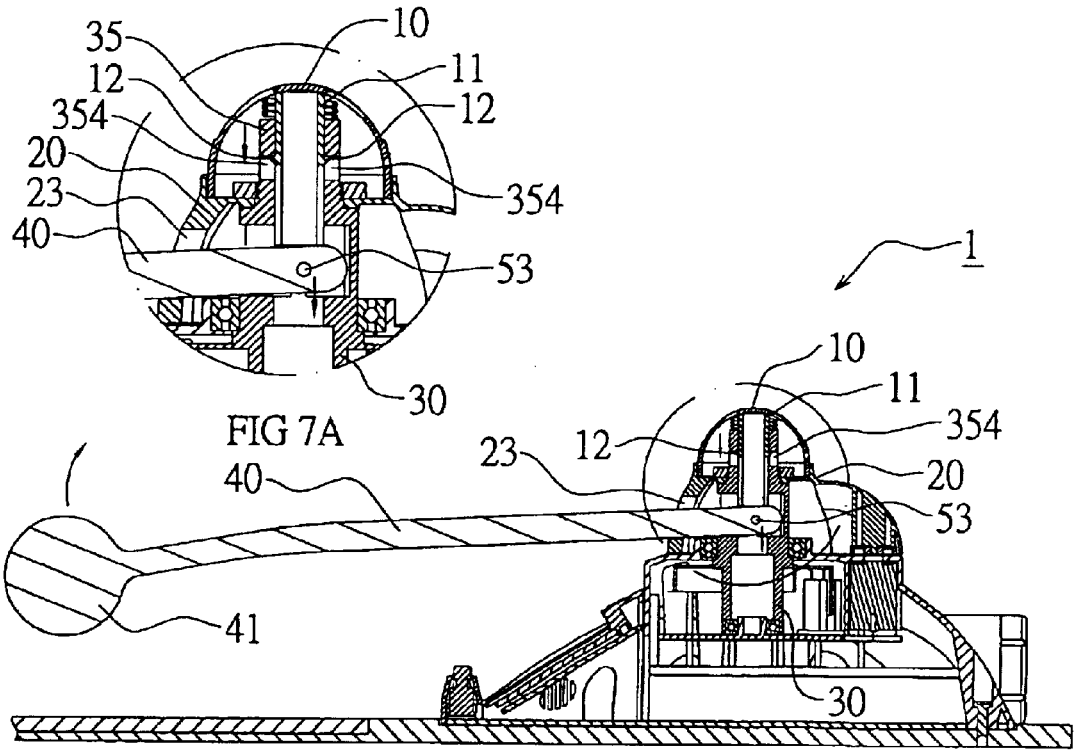
FIG. 7 is a schematic operational view of the golf practicing device as shown in FIG. 6.

As shown in FIGS. 7 and 7A, the adjusting knob 10 is further pressed toward the rotation disk 30 to move the sleeve 11 downward which presses and moves the first end of the bar 40 downward in the first barrel 31 (the pin 53 is movable in the slide slots 33 of the first barrel 31) to pivot the bar 40 upward about the opening 32 of the first barrel 31, so that the practicing ball 41 of the bar 40 is moved upward and located at the uppermost position. At this time, the sleeve 11 of the adjusting knob 10 is moved downward, so that the locking portions 12 of the adjusting knob 10 are moved into and locked in the fourth limit grooves 354 of the rotation disk 30 as shown in FIG. 7A.

Accordingly, the height of the practicing ball 41 of the bar 40 can be adjusted arbitrarily so as to fit users of different heights and statures, thereby facilitating the users operating the golf practicing device 1.

Although the invention has been explained in relation to its preferred embodiment(s) as mentioned above, it is to be understood that many other possible modifications and variations can be made without departing from the scope the present invention. It is, therefore, contemplated that the appended claim or claims will cover such modifications and variations that fall within the true scope of the invention.

What is claimed is:

1. A golf practicing device, comprising a rotation disk, a cover, a bar, and an adjusting knob, wherein:

the rotation disk has a first barrel and a second barrel, the first barrel of the rotation disk has a periphery formed with an opening and two opposite slide slots each communicating with the opening, the second barrel of the rotation disk has a first end extended from the first barrel of the rotation disk and has a periphery formed with two opposite first limit grooves, two opposite second limit grooves, two opposite third limit grooves, and two opposite fourth limit grooves;

the cover is secured on the rotation disk to rotate therewith and having a periphery formed with an oblong slot;

the bar is pivotally mounted on the cover and has a first end extended through the oblong slot of the cover and movably mounted in the opening of the first barrel; and the adjusting knob is movably mounted on the rotation disk and has an inside provided with a sleeve movably mounted in the second barrel of the rotation disk and rested on the first end of the bar.

2. The golf practicing device in accordance with claim 1, wherein the first barrel of the rotation disk has a diameter greater than that of the second barrel.

3. The golf practicing device in accordance with claim 1, wherein the first limit grooves, the second limit grooves, the third limit grooves and the fourth limit grooves of the second barrel are disposed at different locations.

4. The golf practicing device in accordance with claim 1, wherein the cover has an upper portion formed with a recess and a through hole communicating with the recess, and the first barrel of the rotation disk has a first end extended from the rotation disk and a second end formed with an insert inserted into the through hole of the cover.

5. The golf practicing device in accordance with claim 4, further comprising a bearing mounted on the first end of the first barrel of the rotation disk and rotatably mounted between the rotation disk and the cover.

6. The golf practicing device in accordance with claim 1, wherein the second barrel of the rotation disk is formed with an outer thread, and the golf practicing device further comprises a nut screwed on the outer thread of the second barrel and rested on the cover to secure the cover on the rotation disk.

7. The golf practicing device in accordance with claim 1, wherein the first end of the bar is formed with a through hole aligning with the two opposite slide slots of the first barrel, and the golf practicing device further comprises a pin extended through the through hole of the bar and movably mounted in the two opposite slide slots of the first barrel, so that the first end of the bar is movable in the first barrel of the rotation disk.

8. The golf practicing device in accordance with claim 1, wherein the bar has a second end formed with a practicing ball.

9. The golf practicing device in accordance with claim 1, further comprising an elastic member mounted on the sleeve of the adjusting knob and urged between the adjusting knob and the rotation disk.

10. The golf practicing device in accordance with claim 9, wherein the second barrel of the rotation disk has a second end protruded outward from the cover, and the elastic member has a first end urged on the inside of the adjusting knob and a second end urged on the second end of the second barrel of the rotation disk.

11. The golf practicing device in accordance with claim 1, wherein the sleeve of the adjusting knob is provided with two opposite locking portions selectively locked in the first limit grooves, the second limit grooves, the third limit grooves and the fourth limit grooves of the second barrel.

12. The golf practicing device in accordance with claim 1, wherein the pivot the bar is pivoted about the opening of the first barrel.

* * * * *